United States Patent [19]

Sobczak

[11] Patent Number: 5,018,600

[45] Date of Patent: May 28, 1991

[54] EXTENDIBLE LADDER

[76] Inventor: Michael L. Sobczak, 251 Freeman Rd., Cloquet, Minn. 55720

[21] Appl. No.: 482,235

[22] Filed: Feb. 20, 1990

[51] Int. Cl.[5] ..... E06C 9/14

[52] U.S. Cl. ..... 182/70; 182/164; 182/198

[58] Field of Search ..... 182/70, 76, 164, 198, 182/197, 196, 156

[56] References Cited

U.S. PATENT DOCUMENTS

| | | | |
|---|---|---|---|
| 280,527 | 7/1883 | Smiley | 182/70 |
| 1,101,808 | 6/1914 | Michel | 182/164 |
| 1,123,029 | 12/1914 | Smith | 182/70 |
| 2,615,665 | 10/1952 | Baxter | 182/164 |
| 3,874,632 | 4/1975 | Rago | 182/70 |
| 4,189,030 | 2/1980 | Leslie | 182/70 |
| 4,231,449 | 11/1980 | Laurita | 182/164 |
| 4,595,075 | 6/1986 | Rodrigue | 182/70 |
| 4,751,982 | 6/1988 | Wolfe | 182/164 |

*Primary Examiner*—Reinaldo P. Machado
*Attorney, Agent, or Firm*—Kinney & Lange

[57] ABSTRACT

An extendible ladder includes a sealed housing for housing the ladder in a collapsed condition. The ladder mounts to a support wall such as the side of a home or an apartment building. The ladder is extendible during an emergency by opening the sealed housing which allows gravity to extend the ladder. Rollers are included with the ladder to prevent the support wall from interfering with the ladder as the ladder is extended. The housing may take the shape of an awning for mounting over a window in the support wall.

18 Claims, 4 Drawing Sheets

EXTENDIBLE LADDER

BACKGROUND OF THE INVENTION

The present invention relates to extendible ladders. In particular, the invention relates to an extendible ladder housed in a sealed housing for use in escaping from an elevated structure such as a building.

Designs of extendible ladders are well known in the art. Such ladders typically collapse in a lateral or horizontal plane or fold in a vertical direction. Rope ladders which may be rolled for storage are also known in the art.

Ladders which fold in the vertical direction are of particular use for emergency escape purposes. For example, such a ladder may be stored near a window in an elevated floor of a home, or an apartment building. During an emergency, the ladder may be retrieved by an occupant and hung from the window ledge. By extending the rungs of the folded ladder, the occupant can provide an escape through the window to ground.

This type of foldable, extendible escape ladder is described in U.S. Pat. No. 4,751,982 to Wolfe. In the Wolfe patent, protrusions are used to space the ladder from the side of the building. Pins provide a pivotable connection for the folding action of the ladder.

During an emergency, however, valuable time is wasted as the occupant searches for the escape ladder and positions it outside of the building. This time period can be further prolonged if the occupant is injured or otherwise weakened. A long ladder is heavier than a short ladder, further adding to the difficulty in moving the ladder. Additionally, as the ladder is extended from the building to its unfolded state, the side of the building tends to impede the extension of the rungs.

A foldable escape ladder which is easily extendible and quickly operated during an emergency evacuation of a building would be a significant contribution to the art.

SUMMARY OF THE INVENTION

The present invention provides an extendible escape ladder which is mounted externally to a building in a sealed, weatherproof housing. The ladder is always ready for immediate use during an emergency evacuation. The ladder includes wheels to space the ladder from the side of the building as the ladder is unfolded. These wheels prevent the building from interfering with the ladder. The extendible ladder is preferably made of aluminum which reduces weight and further weatherproofs the assembly. Rungs of the ladder are hung together with cross connected straps which pivot about rivets. The folding technique of the present invention reduces the size of the ladder in its folded state and also reduces the weight of the ladder.

In one embodiment of the invention, the sealed housing containing the ladder is mounted to the side of the building. This housing can be placed near an exit such as a window or a porch. In a second embodiment of the invention, a housing resembling an awning is used to house the extendible ladder. The awning style housing can be mounted to the building above a window, similar to an awning.

To extend the ladder, during an emergency, an occupant merely unlatches the housing of the ladder. Once the housing is unlatched gravity fully opens the housing which allows the ladder to drop and extend. In the awning style housing, a pivot allows the ladder to swivel into a downwardly pointed direction and the rungs of the ladder unfold. The wheels space the ladder from the side of the building and prevent the building from interfering with descending of the ladder. Clips may be attached to the side of the building to secure the extended ladder and add stability as the occupant descends from the building.

DETAILED DESCRIPTION OF THE PREFERRED EMBODIMENTS

Figure 1:
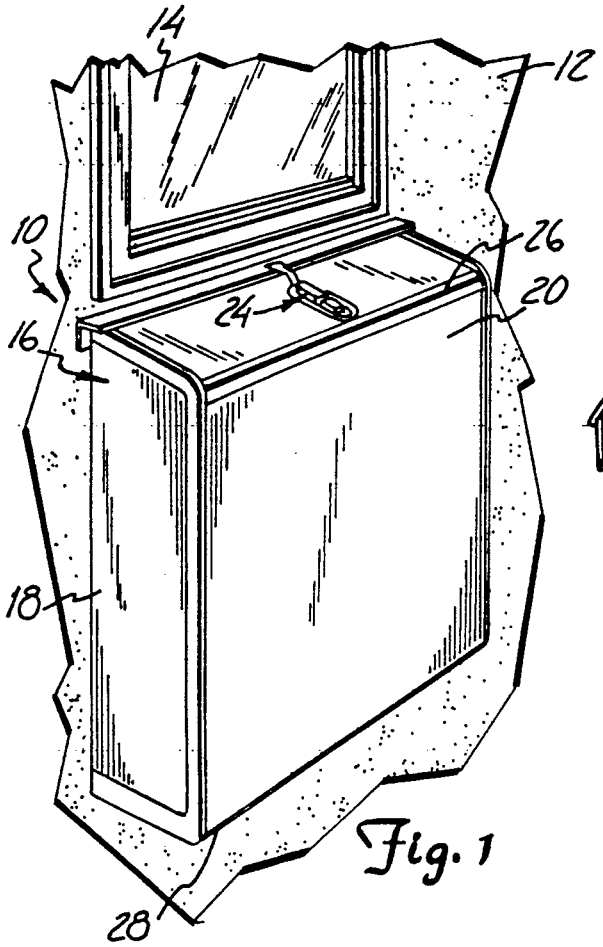
FIG. 1 is a perspective view of a closed ladder housing in accordance with the present invention.

FIG. 1 is a perspective view of an extendible ladder assembly 10 in accordance with the present invention. Extendible ladder assembly 10 is mounted on a support wall 12 below a window 14. Typically, window 14 is two or more stories above ground, and support wall 12 is the exterior wall of a building such as a house or an apartment building.

Extendible ladder assembly 10 includes a housing 16 with a main body 18, front panel 20 and top panel 22. Top panel 22 includes a latch 24. Top panel 22 connects to front panel 20 by hinge 26. Front panel 20 is also connected to a bottom panel (shown in FIG. 2) by a hinge 28.

Figure 2:
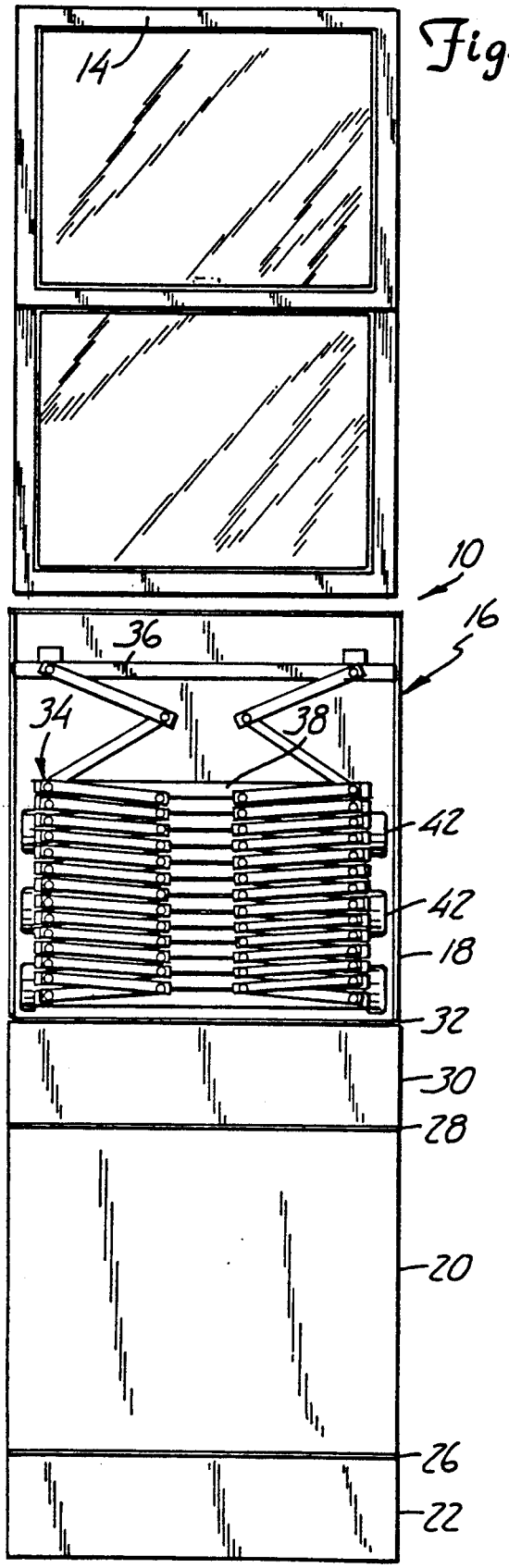
FIG. 2 is a plan view of the ladder housing of FIG. 1 showing an extendible ladder in a folded state, in accordance with the present invention.

FIG. 2 shows the extendible ladder assembly 10 of FIG. 1 with housing 16 in condition FIG. 2 shows a bottom panel 30 connected to front panel 20 by hinge 28 and to main body 18 by hinge 32. In FIG. 2, latch 24 has been unlatched from main body 18 so that top panel 22, front panel 20 and bottom panel 30 are pulled downward by gravity which fully exposes an extendible ladder 34 in accordance with the present invention.

Extendible ladder 34 is mounted to main housing 18 by mounting bracket 36. Extendible ladder 34 includes rungs 38 and straps 40. Ladder 34 is shown in FIG. 2 in a collapsed, nonextended condition.

Figure 3:
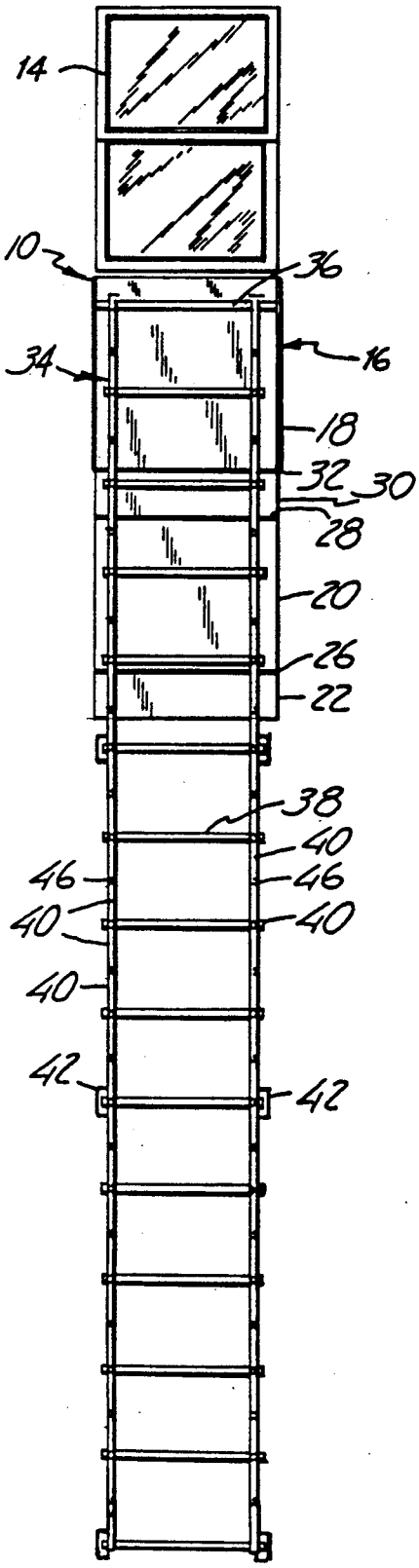
FIG. 3 is a plan view of the extendible ladder of FIG. 2 in a fully extended condition.

FIG. 3 shows extendible ladder assembly 10 including extendible ladder 34 in an extended condition. Extendible ladder 34 includes rollers 42 connected to ladder 34 through spacers 44. Rungs 38 are connected together by rivets 46 which allow straps 40 to pivot. After housing 16 has been unhitched as shown in FIG. 2, gravity pulls extendible ladder 34 into the extended condition shown in FIG. 3. Rollers 42 and spacers 44 keep extendible ladder 34 spaced apart from support wall 12 and prevent support wall 12 from interfering with the extension of ladder 34. As shown FIG. 3, in the open position housing 16 lies flat against support wall 12 and is completely free from interfering with ladder 34.

Figure 4:
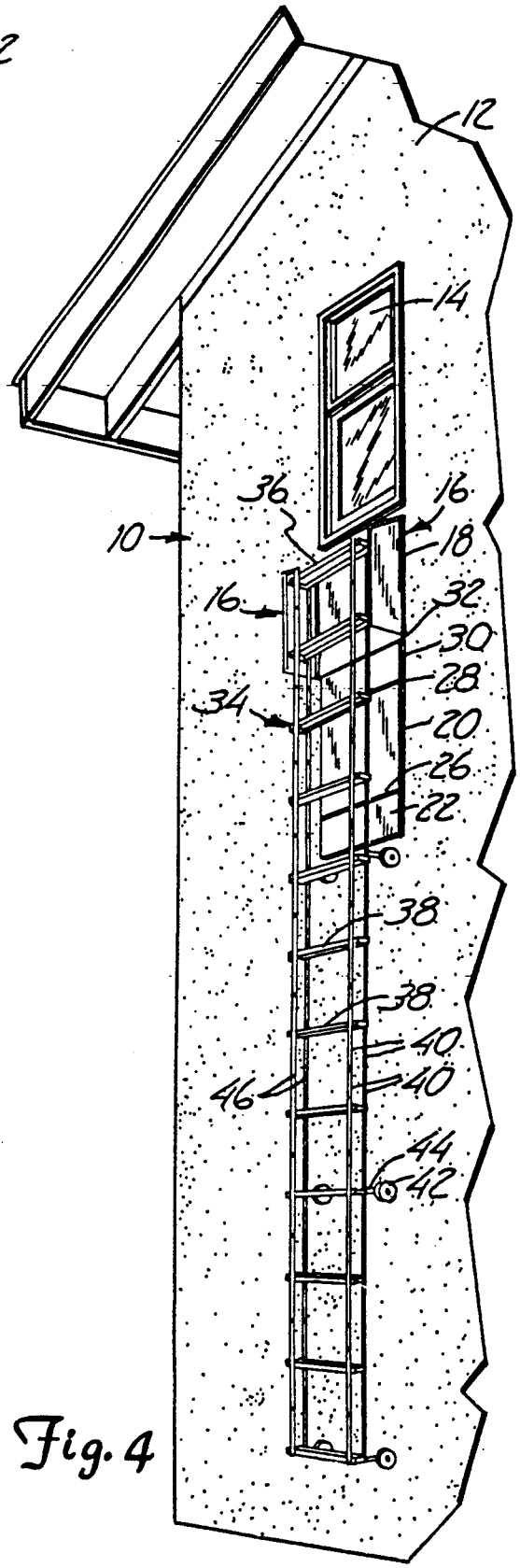
FIG. 4 is a perspective view of a portion of the extendible ladder.

FIG. 4 shows a portion of extendible ladder 34 which more clearly shows the movement of straps 40 and rungs 38. FIG. 4 shows a portion of ladder 34 in a partially extended condition. Rivets 46 allow straps 40 to pivot from their nonextended position when ladder 34 is collapsed and their extended, open position when extendible ladder 34 is fully extended.

Figure 5:
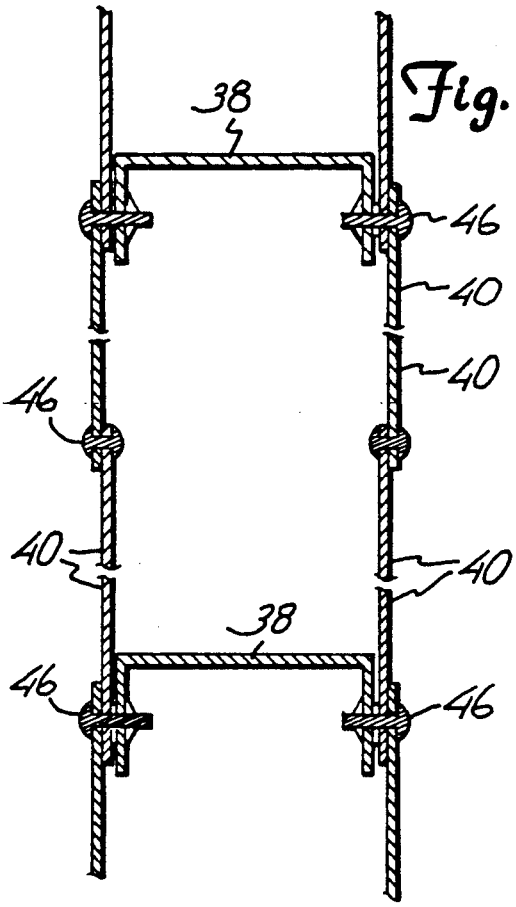
FIG. 5 is a side view of the foldable ladder showing the connection between adjacent ladder rungs.

FIG. 5 is a side view of extendible 34 showing two sets of straps 40 and rivets 46 on each side of a rung 38.

Figure 6:
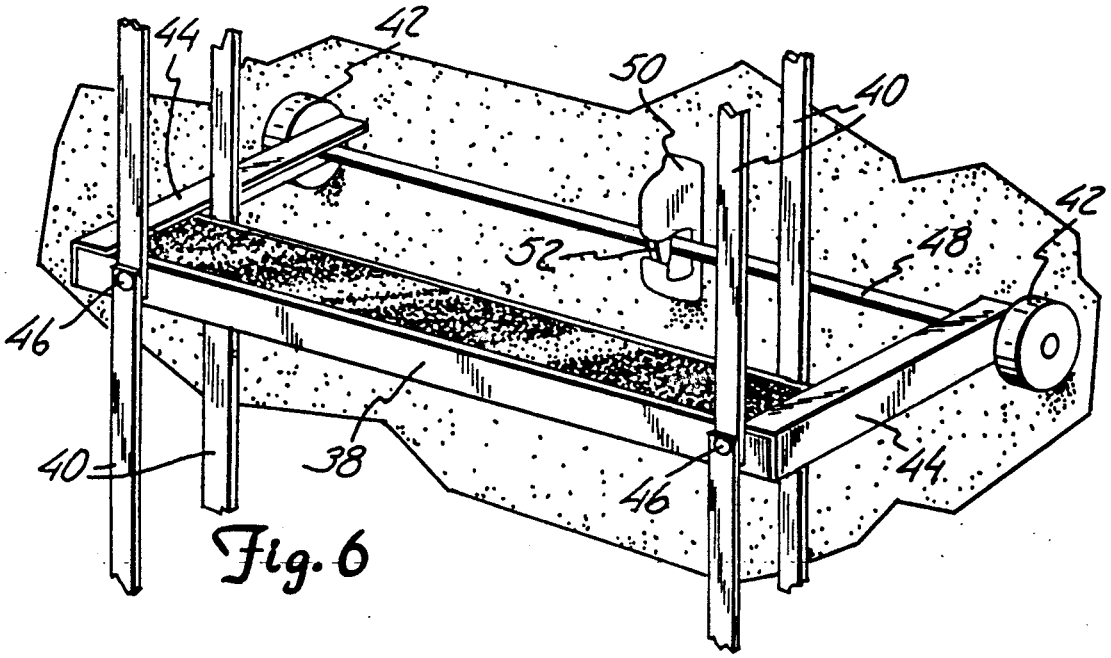
FIG. 6 is a perspective view of a single rung in the extendible ladder.

FIG. 6 is a perspective view of a single rung 38 of ladder 34 including rollers 42. In the embodiment shown in FIG. 6, an axle 48 extends between two adjacent rollers 42. Rollers are spaced apart from rung 38 by spacers 44 so that during use rung 38 is separate from support wall 12. A clasp 50 is mounted to support wall 12 and is positioned to grasp axal 48. Clasp 50 can be used to secure extendible ladder 34 against support wall 12 and stabilize ladder 34 during use. Clasp 50 includes a lever 52 which is preferably a gravity latch. Clasp 50 is positioned on wall 12 so that when ladder 34 is extended axle 48 pushes lever 52 open. Gravity urges lever 52 to return to a closed position after being opened. During operation, the ladder can be fully extended before being swung inward so that clasp 50 automatically grabs axle 48.

Figure 7:
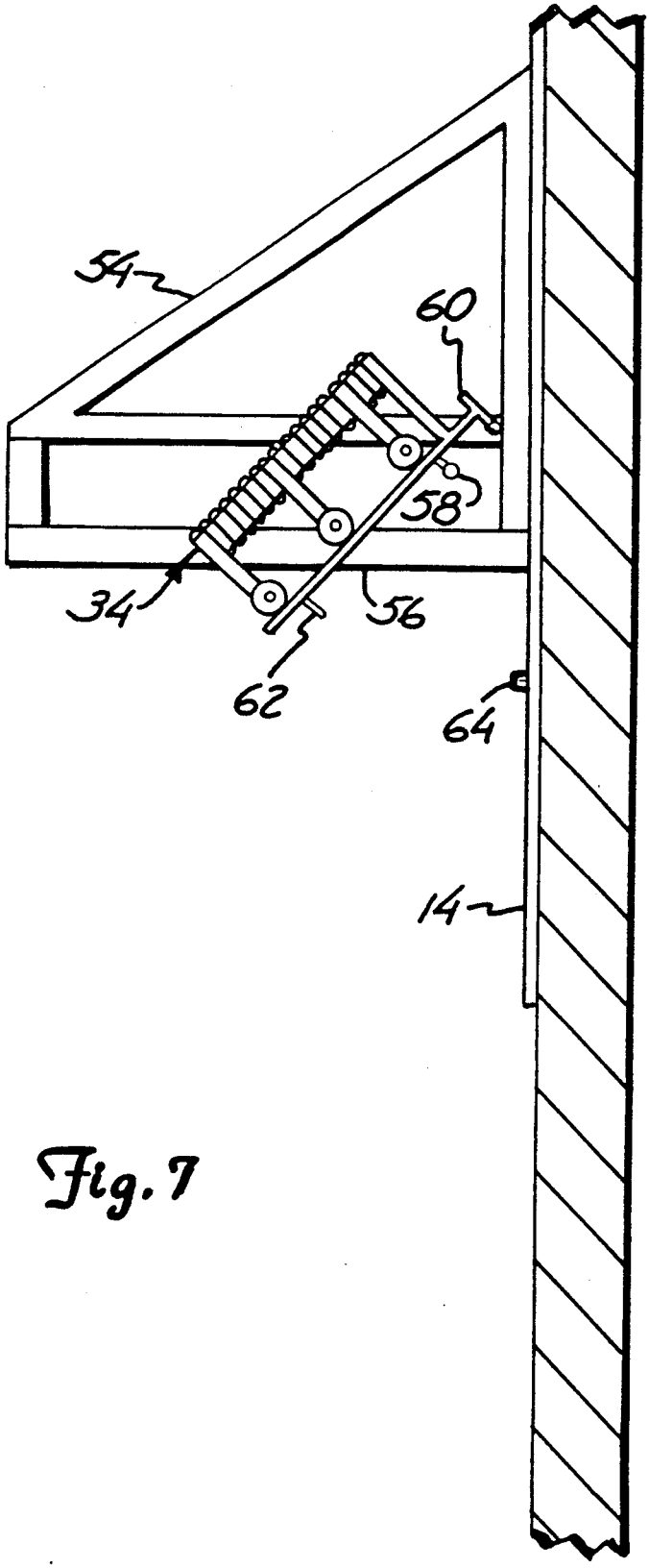
FIG. 7 is a side view of another embodiment of the present invention.

FIG. 7 shows another embodiment of the present invention in which an awning like housing 54 is mounted above window 14 on support wall 12. Housing 54 includes a trap door 56 which swings open when pulled at handle 58. Extendible ladder 34 is mounted to bracket 60 which also supports trap door 56. Bracket 60 is pivotally mounted to housing 54. A spacer 62 is used to space trap door 56 from window 14 at stops 64. In operation, an occupant of a building pulls handle 58 which opens trap door 56 and allows extendible ladder 34 to extend. Handle 58 is connected to a latch (not shown) distal from bracket 60 through cable (now shown) in trap door 56 to secure trap door 56 in a closed position. With ladder 34 extended, the occupant can climb down to safety.

In the embodiment of the present invention shown in FIGS. 1-6, an occupant unlatches latch 24 which allows housing 16 to open and extendible ladder 34 to descend. The occupant can then safely descend from window 14. Extendible ladder 34 is constructed with aluminum or some other noncorroding material. The configuration of support straps 40 and rivets 46 allow the extendible ladder of the present invention to be compactly stored when not in use. Housings 16 and 54 are weather proof tight and may include a seal around their edges to prevent water from entering the housing.

With the present invention, the escape ladder is always easily accessible by an occupant during an emergency. The ladder is extended to its full length by merely unlatching a latch or pulling a handle. With the present invention, even weak or injured occupants can easily extend the ladder during an emergency. The rollers in the present invention allow the extendible ladder to drop without interference from the building.

The extendible ladder of the present invention can be mounted near a window, porch or other such opening which would typically be present in a dwelling. The present invention is suitable for any situation in which an extendible ladder would be useful.

In another embodiment of the present invention, an alarm switch is mounted in the housing to automatically trigger a fire alarm when the housing is opened.

Although the present invention has been described with reference to preferred embodiments, workers skilled in the art will recognize that changes may be made in form and detail without departing from the spirit and scope of the invention.

What is claimed is:

1. An extendible ladder assembly comprising:

a plurality of parallel rungs each rung having sides which define a plane;

a plurality of supports connected to the sides of adjacent parallel rungs, the supports being foldable between a first collapsed position wherein the supports fold along the sides of the rungs and are generally coplanar with the planes of the rungs and a second extended position for supporting the plurality of rungs;

a mount operable coupled to the rungs for mounting the rungs; and a housing for supporting the mount and for enclosing the plurality of parallel rungs and the plurality of supports when the plurality of supports are in the first, collapsed position.

2. The extendible ladder assembly of claim 1 wherein the housing comprises a sealed housing which forms an enclosure having a top piece and a back piece wherein the top piece is slanted downward from the back piece and forms an angle less than 90 degrees to the back piece.

3. The extendible ladder assembly of claim 1 including rollers rotatably connected to a spacer which is rigidly coupled to at least one of the plurality of parallel rungs.

4. The extendible ladder assembly of claim 1 wherein the supports comprise first and second arms, the first arm connected to one of the plurality of rungs and the second arm connected to an adjacent rung of the plurality of rungs, the first and second arms pivotably mounted together at a pivotable mount.

5. The extendible ladder of claim 4 wherein the pivotable mount comprises a rivet.

6. The extendible ladder of claim 1 wherein the housing comprises an awning for mounting to a side of a building, the awning including a bottom panel, the bottom panel pivotally mounted to the awning wherein the bottom panel opens outward, away from the building.

7. The extendible ladder of claim 1 wherein the mount comprises a pivotable mount.

8. The extendible ladder of claim 1 wherein the housing includes a latchable panel, movable between a first closed position and a second open position.

9. An extendible ladder assembly comprising:

a plurality of parallel rungs having sides which define a plane;

a plurality of supports connected to adjacent parallel rungs, the supports being foldable between a first collapsed position and a second extended position for supporting the plurality of rungs;

a mount operably coupled to the rungs for mounting the rungs; and rollers rotatably coupled to a spacer which is rigidly connected to the plurality of rungs, the rollers spaced apart from the plurality of rungs for preventing a support wall from interfering with the plurality of supports as the plurality of supports move between the first collapsed position and the second extended position.

10. The extendible ladder assembly of claim 9 wherein the supports comprise first and second arms, the first arm connected to a side of one of the plurality of rungs and the second arm connected to a side of an adjacent rung of the plurality of rungs, and foldable between a first collapsed position wherein the arms fold along the sides of the rungs and are generally coplanar with the planes of the rungs and a second extended position, the first and second arms pivotally mounted together at a pivotable mount.

11. The extendible ladder of claim 10 wherein the pivotable mount comprises a rivet.

12. The extendible ladder of claim 9 including a housing for enclosing the plurality of rungs and the plurality of supports when the plurality of supports are in the first collapsed position.

13. The extendible ladder assembly of claim 12 wherein the housing comprising a sealed housing.

14. The extendible ladder of claim 9 wherein the housing comprises an awning.

15. The extendible ladder of claim 9 wherein the housing includes a latchable panel, movable between a first closed position and a second open position.

16. An extendible ladder assembly comprising:

a plurality of parallel rungs each rung having sides which define a plane;

a plurality of supports connected to the sides of adjacent parallel rungs, the supports being foldable between a first collapsed position wherein the supports fold along the sides of the rungs and are generally coplanar with the planes of the rungs and a second extended position for supporting the plurality of rungs;

a mount operably coupled to the rungs for mounting the rungs;

a housing for supporting the mount and for enclosing the plurality of parallel rungs and the plurality of supports when the plurality of supports are in the first, collapsed position; and a clasp for stabilizing the plurality of rungs when the supports are in the second extended condition.

17. The extendible ladder of claim 16 including rollers carried by an axle connected to the plurality of rungs, the clasp adapted for receiving the axle.

18. An extendible ladder assembly comprising:

a plurality of parallel rungs having sides which define a plane;

a plurality of supports connected to adjacent parallel rungs, the supports being foldable between a first collapsed position and a second extended position for supporting the plurality of rungs;

a mount operably coupled to the rungs for mounting the rungs;

rollers rotatably coupled to a spacer which is rigidly connected to the plurality of rungs, the rollers spaced apart from the plurality of rungs for preventing a support wall from interfering with the plurality of supports as the plurality of supports move between the first collapsed position and the second extended position; and a clasp for stabilizing the plurality of rungs when the supports are in the second extended condition.

* * * * *